US006939158B2

(12) United States Patent
Moffett et al.

(10) Patent No.: US 6,939,158 B2
(45) Date of Patent: Sep. 6, 2005

(54) ELECTRONIC INTERCONNECT FOR PDA/ CELL PHONE

(75) Inventors: Howard Moffett, Park City, UT (US); Brad Brown, Salem, UT (US); Steve Rasmussen, Provo, UT (US); Marcus Darrington, Provo, UT (US)

(73) Assignee: ATL Technology LC, Springville, UT (US)

( * ) Notice: Subject to any disclaimer, the term of this patent is extended or adjusted under 35 U.S.C. 154(b) by 0 days.

(21) Appl. No.: 10/742,648

(22) Filed: Dec. 19, 2003

(65) Prior Publication Data

US 2004/0184227 A1 Sep. 23, 2004

Related U.S. Application Data

(60) Provisional application No. 60/435,898, filed on Dec. 20, 2002.

(51) Int. Cl.[7] ..... H01R 4/50; H01R 13/625

(52) U.S. Cl. ..... 439/346; 439/357; 439/540.1

(58) Field of Search ..... 439/346, 79, 540.1, 439/357

(56) References Cited

U.S. PATENT DOCUMENTS

| | | | | |
|---|---|---|---|---|
| 5,224,866 A | * | 7/1993 | Nakamura et al. | 439/81 |
| 5,667,392 A | * | 9/1997 | Kocher et al. | 439/79 |
| 5,876,248 A | | 3/1999 | Brunker et al. | 439/608 |
| 6,171,138 B1 | | 1/2001 | Lefebvre et al. | 439/500 |
| 6,203,335 B1 | | 3/2001 | Chang | 439/79 |
| 6,231,390 B1 | | 5/2001 | Chang | 439/607 |
| 6,302,722 B1 | | 10/2001 | Simmel | 439/374 |
| 6,322,377 B2 | * | 11/2001 | Middlehurst et al. | 439/79 |
| 6,341,218 B1 | | 1/2002 | Poplawsky et al. | 455/569.1 |
| 6,383,010 B1 | | 5/2002 | Mayo et al. | 439/357 |
| 6,398,577 B1 | * | 6/2002 | Simmel et al. | 439/357 |
| 6,540,542 B1 | * | 4/2003 | Simmel | 439/352 |
| 6,558,189 B2 | * | 5/2003 | Groebe et al. | 439/529 |

* cited by examiner

*Primary Examiner*—Hae Moon Hyeon
(74) *Attorney, Agent, or Firm*—Thorpe North & Western LLP

(57) ABSTRACT

A method and apparatus for improving the co-planarity between conductive structures exposed in an interface connector for a portable electronic device. The interface connector includes an elongate housing having a front surface and a bottom surface. The front surface is configured to be at least partially exposed at a peripheral portion of the portable electronic device. The front surface defines port openings in the elongate housing and the bottom surface defines plate openings therein. The plate openings are configured to receive and retain conductive structures and are configured to be at least partially exposed at the bottom surface of the elongate housing and at least partially exposed at the port openings to provide electrical interconnection to the portable electronic device. With this arrangement, the conductive structures in the interface connector are substantially co-planar with each other to provide improved and more reliable electrical interconnection with the portable electronic device.

15 Claims, 6 Drawing Sheets

ELECTRONIC INTERCONNECT FOR PDA/ CELL PHONE

This application claims priority of application Ser. No. 60/435,898, filed on Dec. 20, 2002.

FIELD OF THE INVENTION

The present invention relates generally to interconnections for a personal digital assistant and/or a portable phone. More particularly, the present invention relates to the configuration and method of making an interface connector for a personal digital assistant and/or a portable phone.

BACKGROUND OF THE INVENTION

Portable telephone systems and personal digital assistants ("PDA") have gained widespread acceptance as an efficient means for voice and data communications. While early mobile units were large and complex, miniaturization has made possible hand-held units with full functional telephony capabilities allowing the user freedom to use a phone in a mobile environment or at a location remote from a hard wired connection to an existing telephone system. In addition, the cost of purchasing and using a portable phone has substantially declined and the quality and clarity of communication over a portable phone has increased causing increased and widespread demand for portable phones by the public. Such a demand has resulted in the competitive need for increased reliability in the portable phone and PDA.

Portable phones and PDA's typically include an electrical interface connector having both a power port and data port for charging and transferring data to the portable phone and PDA. Such an interface connector includes a dielectric elongate housing with electrically conductive terminals in each of the power port and data ports for electrically conducting and engaging with a power cable and data cable. The electrically conductive terminals are interconnected to circuitry in the portable phone and PDA.

The power cable and data cable are most often configured to engage with the interface connector and maintain such engagement with a latching system which holds the power cable and/or data cable in a mated condition. Such a latching system also is releasable to allow the power cable and/or data cable to be disengaged from the mated condition.

One of the problems with latching systems for the power cable and data cable described above is the potential of damage to the latches, themselves. In other words, too often the power cable and/or data cable is hastily positioned and latched in a misaligned fashion which causes strain and fatigue on the latches. The result may be inadvertent damage to the latches. Often the latches of the latching system are formed from a polymeric material that experiences torque and stresses, reducing the life span of the latches.

Another problem with such systems relates to the interface connector of the portable phone and PDA. Such an interface connector is a small, elongate and narrow structure which includes a housing molded of dielectric polymeric material or the like. When latching cavities are formed in the very narrow housing along with the cavities for the power port and data ports, open spaces are created which tend to allow the molded plastic housing of the interface connector to bow. The interface connector is designed for mounting on a printed circuit board, and even the slightest bowing of the housing prevents the connector from lying completely flat on the circuit board. Obviously, such bowing leads to misalignment of circuit connections with attendant circuit problems.

Another problem relating to obtaining and maintaining interconnection between the printed circuit board and the interface connector relates to co-planarity between the electrically conductive terminals formed in the housing of the interface connector. Conventionally, the housing is configured to receive the conductive terminals from the back side surface or the front side surface. However, inserting such conductive structures into the back or front of the housing has proved difficult to achieve substantial co-planarity between each of the conductive structures. Failure in achieving substantial planarity between the conductive structures reduces reliability in the interconnection between the conductive structures and conductive points on a printed circuit board for a PDA or portable phone.

SUMMARY OF THE INVENTION

It has been recognized that it would be advantageous to develop an improved method and structure to provide conductive structures that are substantially coplanar with each other.

The present invention relates to a method and apparatus for providing an elongate connector housing for a portable electronic device configured to receive conductive plates therein. The elongate connector housing includes a front side configured to be at least partially exposed at a peripheral portion of the portable electronic device. The front side defines port openings therein configured to receive at least one of power and data interconnections to the portable electronic device. The elongate connector housing includes a bottom side adjacent to the front side. The bottom side includes plate openings defined therein. The plate openings being configured to receive the conductive plates at the bottom side to provide substantially consistent insert depth between the conductive plates with respect to the bottom side for electrical interconnection to a printed circuit board disposed in the portable electronic device.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

While the specification concludes with claims particularly pointing out and distinctly claiming that which is regarded as the present invention, the advantages of this invention may be ascertained from the following description of the invention when read in conjunction with the accompanying drawings, in which:

DETAILED DESCRIPTION

Figure 1:
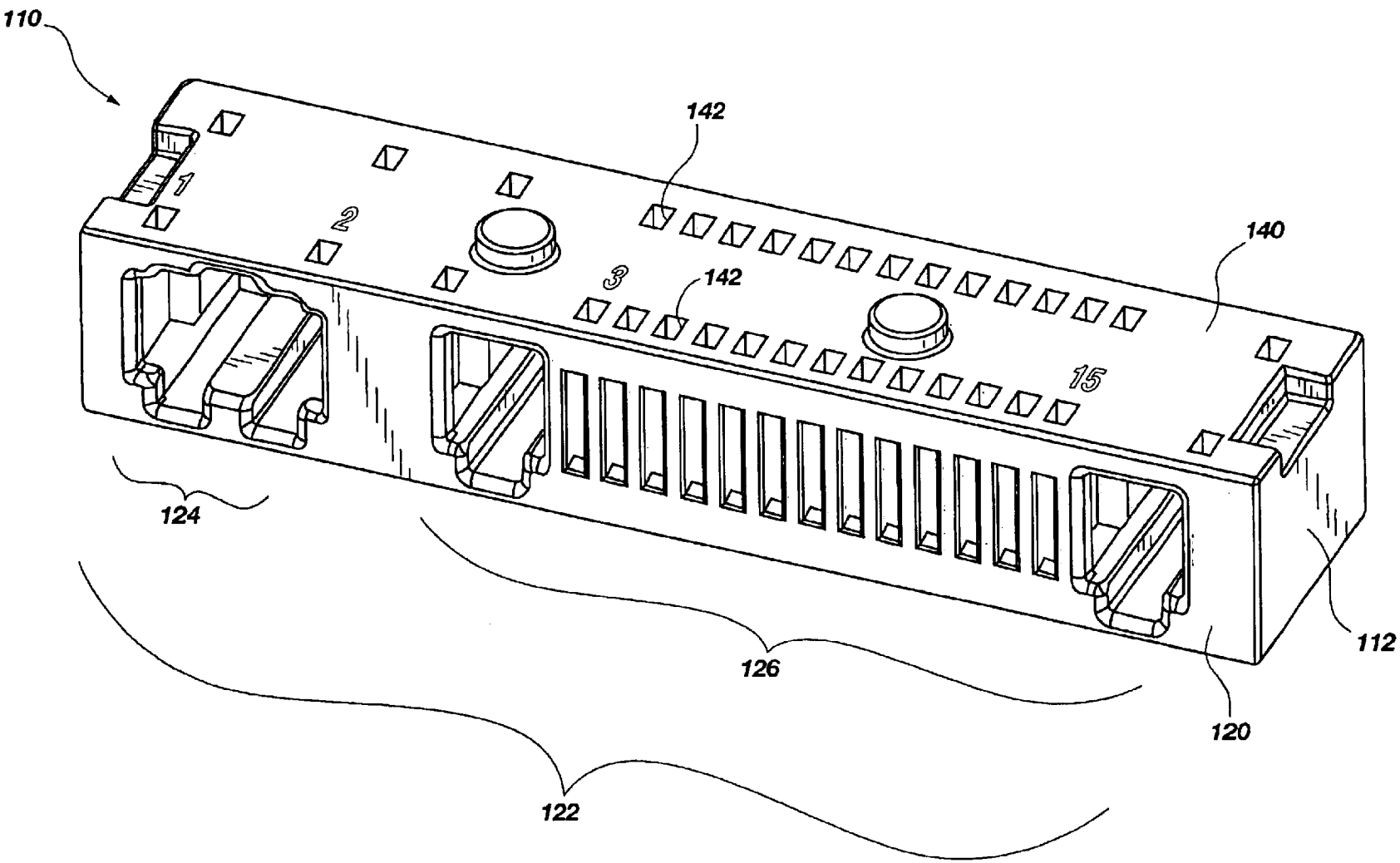
FIG. 1 illustrates a perspective front and top view of an elongate housing for an interface connector without electrically conductive strike plates disposed therein, depicting a power port and data ports defined in the front surface of the interface connector.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
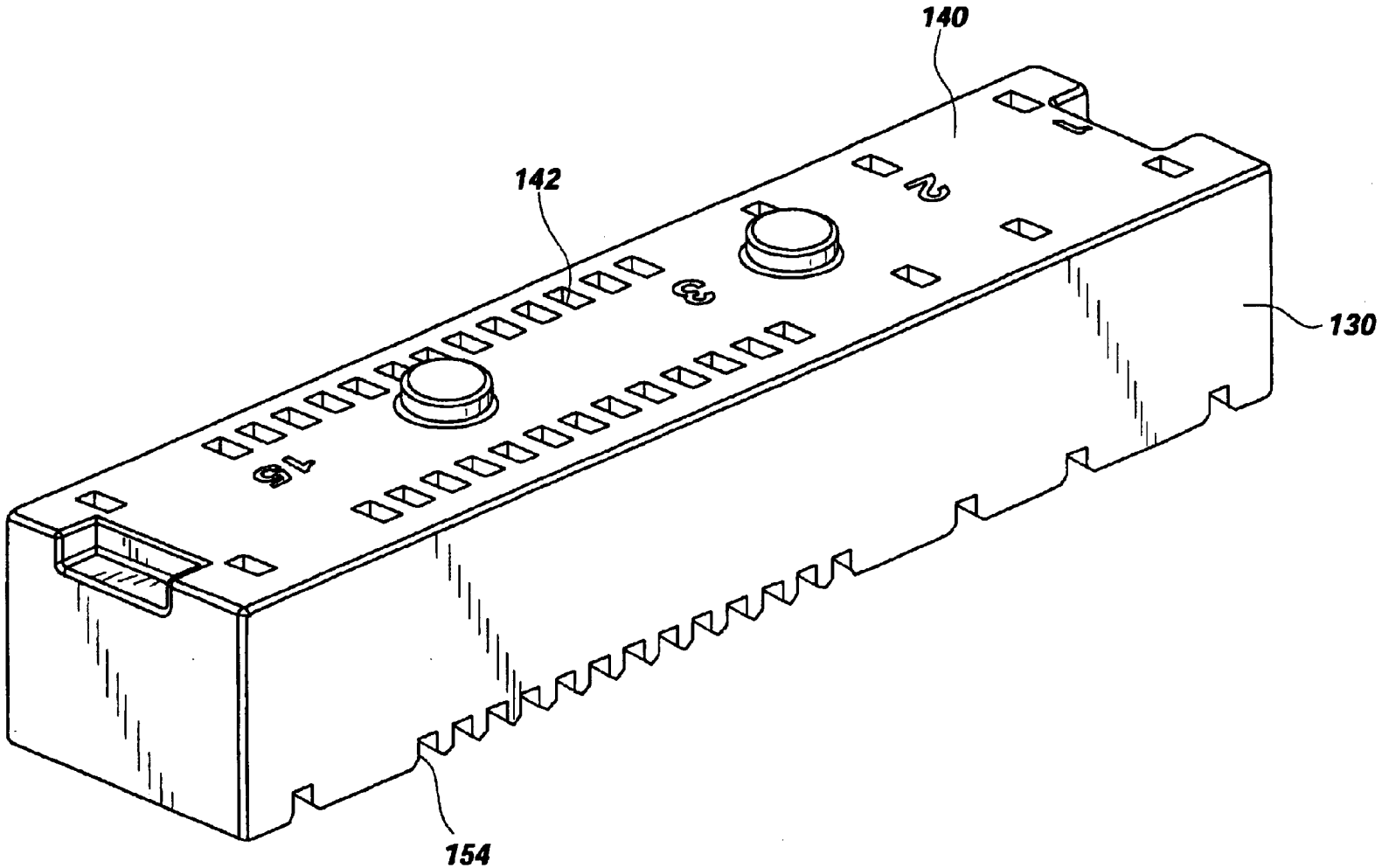
FIG. 2 illustrates a perspective back and top view of the elongate housing for an interface connector, depicting a notch in a bottom portion of the back surface of the elongate housing.
Figure 3:
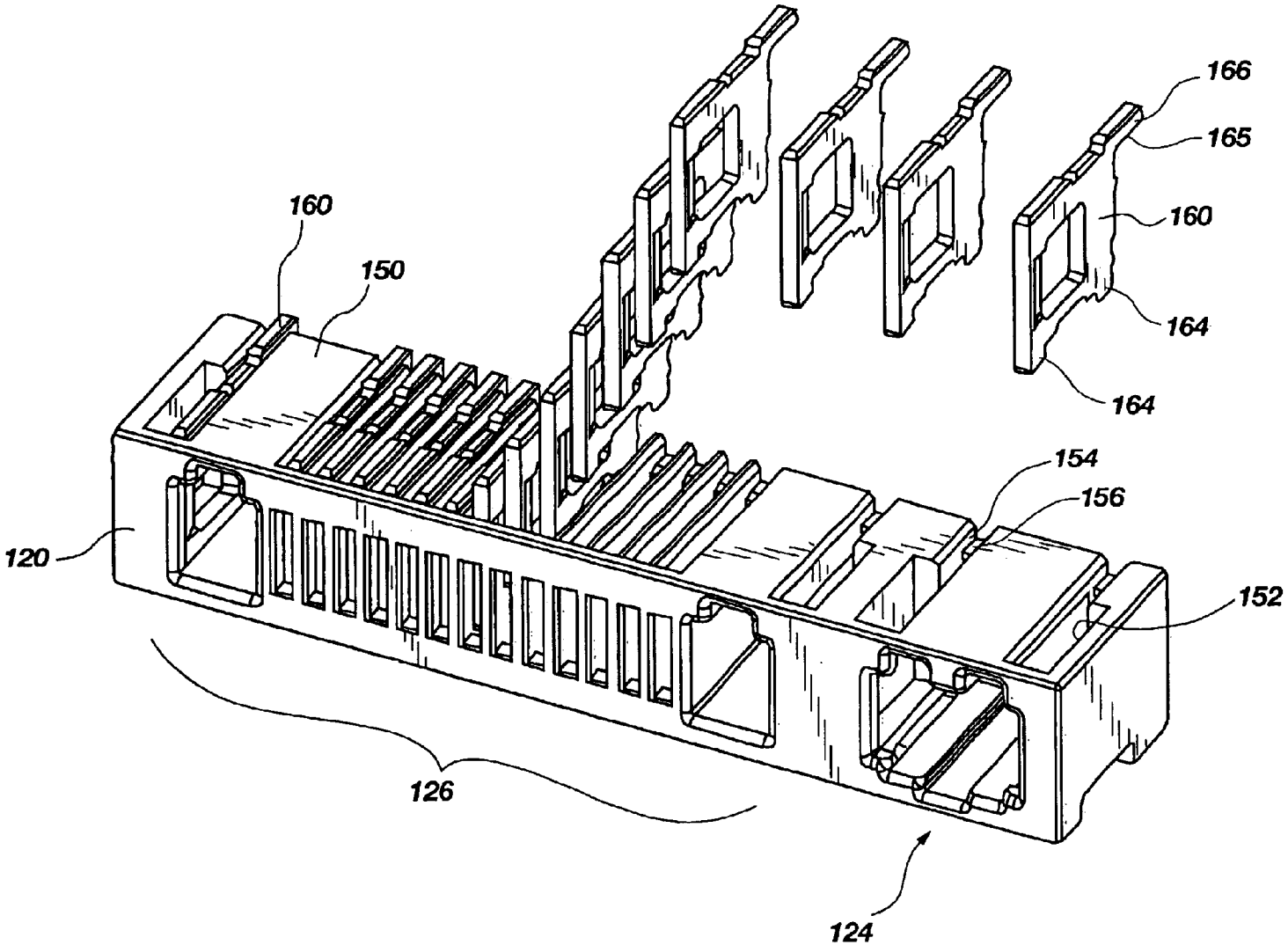
FIG. 3 illustrates a perspective bottom and front view of the interface connector, depicting the strike plates being received into the bottom surface of the elongate housing of the interface connector.

FIGS. 1–3 illustrate respective front, back and bottom perspective views of an interface connector 110. The interface connector 110 is configured to be positioned proximate an inside peripheral portion of a portable electronic device (not shown), such as a personal digital assistant ("PDA") and/or portable phone. The interface connector 110 is configured to interface with a power cable and/or data cable to provide power and data transfer to the PDA and/or portable phone, which will be described in further detail herein.

The interface connector 110 includes an elongate housing 112 with an elongated cubic shape. With such elongated cubic shape, the elongate housing 112 includes a front surface 120, a back surface 130, a top surface 140 and a bottom surface 150. The elongate housing 112 can be formed from a dielectric material, such as a polymeric or polyimide material. Other dielectric materials can also be utilized, such as ceramics, composites or the like.

The front surface 120 of the elongate housing 112 includes a plurality of ports 122. The front surface 120 with the ports 122 defined therein are configured to be exposed at a peripheral portion of a portable electronic device, such as a PDA and/or portable phone. The plurality of ports 122 may include a power port 124 and data ports 126. The power port 124 may be a single cavity extending from the front surface 112 into a portion thereof. The power port 124 can be configured to provide both the functions of latching and transmitting power therethrough. The data ports 126 may include multiple cavities, including cavities configured for transmitting data and/or power and cavities configured for latching a data cable thereto. More specifically, the two outer ports of the data ports 126 can be configured for latching and/or transmitting power. The ports between the two outer ports of the data ports 126 can be configured for transmitting data. Such ports 122 can extend partially into the front surface 120, without extending through the back surface 130.

The top surface 140 can include multiple alignment-retaining openings 142 defined therein. Each of the alignment-retaining openings 142 extends through the top surface 142 and into one of the ports 122. Each port 122 can communicate with at least two alignment-retaining openings 142.

With respect to FIGS. 2 and 3, the bottom surface 150 includes plate openings 152 defined in the elongate housing 112. Such plate openings 152 can be-sized and configured to receive strike plates 160 such that each plate opening 152 can be configured to receive a single strike plate 160. Each plate opening 152 can extend through the bottom surface 150 into a corresponding one of the ports 122. Also, each plate opening can include a channel portion 154 defined in the bottom surface 150 which extends from an edge of the plate opening 152 to an edge of the bottom surface 150. The channel portion 154 can extend into the back surface 130 so as to define a notch in the back surface 130 of the elongate housing 112. The channel portion 154 includes a stopper 156, which serves as a barrier and can be defined in a substantially parallel plane as the bottom surface 150 of the elongate housing 112. In one embodiment, each plate opening 152 can be aligned and configured to correspond with at least two of the alignment-retaining openings 142. Such alignment between the plate openings 152 in the bottom surface 150 and the alignment-retaining openings 142 in the top surface provides a mechanism for inserting, aligning and retaining strike plates 160 into the elongate housing 112.

Figure 4:
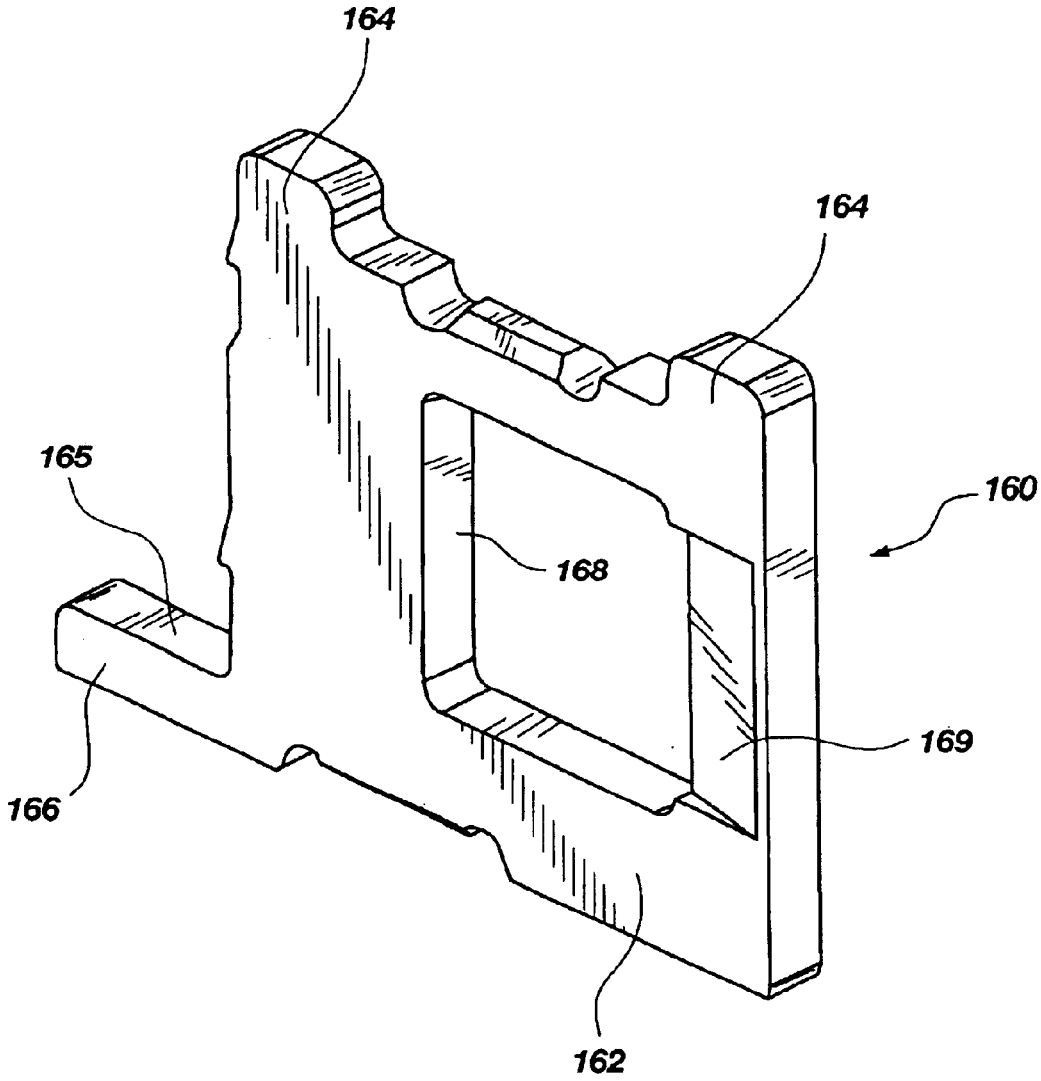
FIG. 4 illustrates an enlarged perspective view of one embodiment of a strike plate, depicting one strike plate configuration having a contact portion and window defined in the strike plate and a hanging shoulder extending therefrom.

Turning to FIG. 4, an enlarged perspective view of the strike plate 160 is illustrated. The strike plate 160 is a conductive material configured for conducting power and/or transmitting signals. The strike plate 160 can be any suitable electrically conductive material, such as phosphor bronze or titanium copper or alloys thereof. Further, the strike plate 160 may be gold plated for optimal conductivity and minimal degradation. Such gold plating may be formed on the strike plate by electrolysis or an electrolytic process.

With reference to FIGS. 1, 2 and 4, the strike plate 160 includes a main plate portion 162 having at least two extension portions 164 extending upward from the main plate portion 162 and a shoulder portion 166 extending laterally from the main plate portion 162. The strike plates 160 can be sized and configured to be inserted into the plate openings 152 with at least two extension portions 164 configured to slide and fit in the alignment-retaining openings 142. Further, the shoulder portion 166 of the strike plates 160 can be sized and configured to sit in the channel portion 154 so that a top surface 165 of the shoulder portion 166 abuts with the stopper 156 in the channel portion 154 of the elongate housing 112.

The strike plate 160 also defines a window 168 therein with a contact portion 169 immediately adjacent thereto. The contact portion 169 of the strike plate can be a sloping notch such that a thickness of the strike plate 160 varies along a length toward the window 168 of the contact portion 169 and, specifically, the thickness of the strike plate 160 decreasing toward the window 168. With this arrangement, the strike plate 160 can be substantially, precisely positioned in each of the openings 152 in the elongate housing 112 with the upper surface 165 of the shoulder portion 166 abutting with the stopper 156 of the channel portion 154 in the elongate housing 112. Furthermore, the window 168 and contact portion 169 defined in the strike plate 160 can act to slidingly receive, engage and latch, as well as slidingly disengage, with an interconnect device, such as a portion of a power cable and/or a data cable (not shown).

Figure 5:
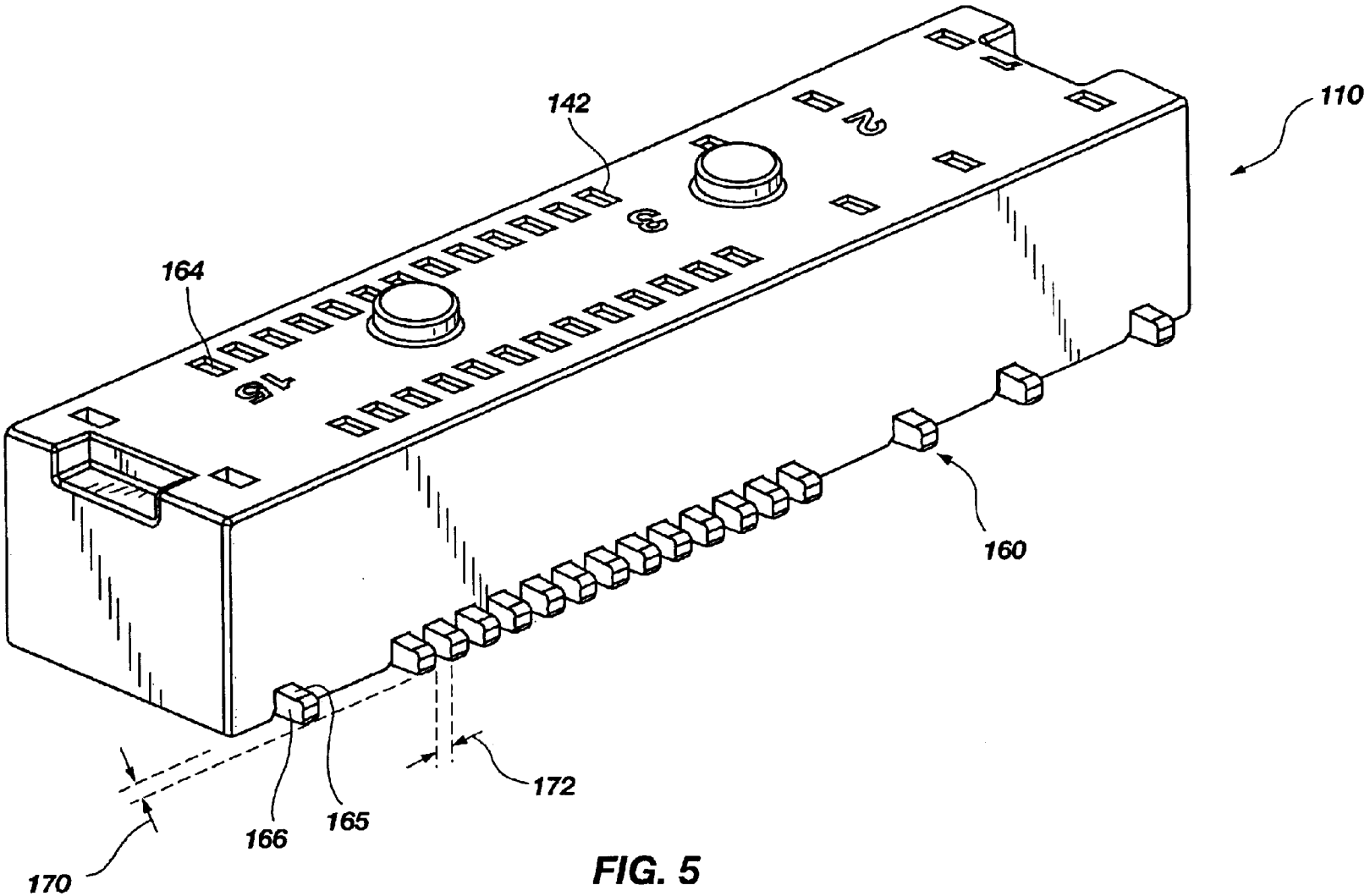
FIG. 5 illustrates a back-side perspective view of the interface connector, depicting the strike plates disposed in the interface connector having substantial co-planarity between each of the strike plates.

Referring to FIGS. 3 and 5, the strike plates 160 are positioned to be inserted into the plate openings 152 into the bottom surface 150 of the elongate housing 112. The plate openings 152 are sized and configured such that when the strike plate 160 is fully inserted into the plate opening 152, the upper surface 165 of the shoulder portion 166 abuts with the stopper 156 with the shoulder portion 166 disposed into the channel portion 154 as well as having the extension portions 164 of the strike plate 160 disposed in the alignment-retaining openings 142 such that the ends of the extension portions 164 are exposed at the top surface 140 of the elongate housing 112. The alignment-retaining openings 142 are sized and configured such that the extension portions 164 fit snug with an interference type fit. With this arrangement, each of the plate openings 152 receives a strike plate 160 through the bottom surface 150 of the elongate housing 112.

By receiving the strike plates 160 in the bottom surface 150 of the elongate housing 112, the co-planarity between the strike plates 160 collectively with the shoulder portion 166 exposed at the bottom surface 150 of the elongate housing 112 is within approximately 0.05 mm or less. Such variation in co-planarity is a large improvement over the conventional co-planarity averaging between approximately 0.1 mm and 0.075 mm. The improvement is achieved by the elongate housing 112 configuration of having the plate openings 152 in the bottom surface 150 of the elongate housing 112. More specifically, the upper surface 165 on the shoulder portion 166 of the strike plates is configured to abut with the stopper 156 in the channel portion 154 of the elongate housing 112, which provides a consistent barrier for each of the strike plates 160. As such, the strike plates 160 can be inserted into the plate openings 152 with a substantially consistent insert depth to achieve substantial planarity 170 between each of the strike plates 160 with respect to the bottom surface 150 of the interface connector 110.

Further, the plate openings 152, channel portion 154 and alignment-retaining opening 142 in the elongate housing 112 act in conjunction to provide substantial alignment and substantial consistent pitch 172 between each of the strike plates 160. Such alignment and consistent pitch is achieved since each strike plate 160, with the extension portions 164 and shoulder portion 166, is aligned and positioned with respective alignment-retaining openings 142 and channel portion 154 to provide a three-point contact. In this manner, the three point contact provides improved alignment, stability and substantially consistent pitch between the strike plates 160 so that the strike plates 160 are substantially positioned as intended. In addition, the strike plates 160 can be dislodged from the elongate housing if desired by simply exerting a force through the alignment-retaining openings against the exposed end of the extension portions 164 of the strike plates 160.

Figure 6:
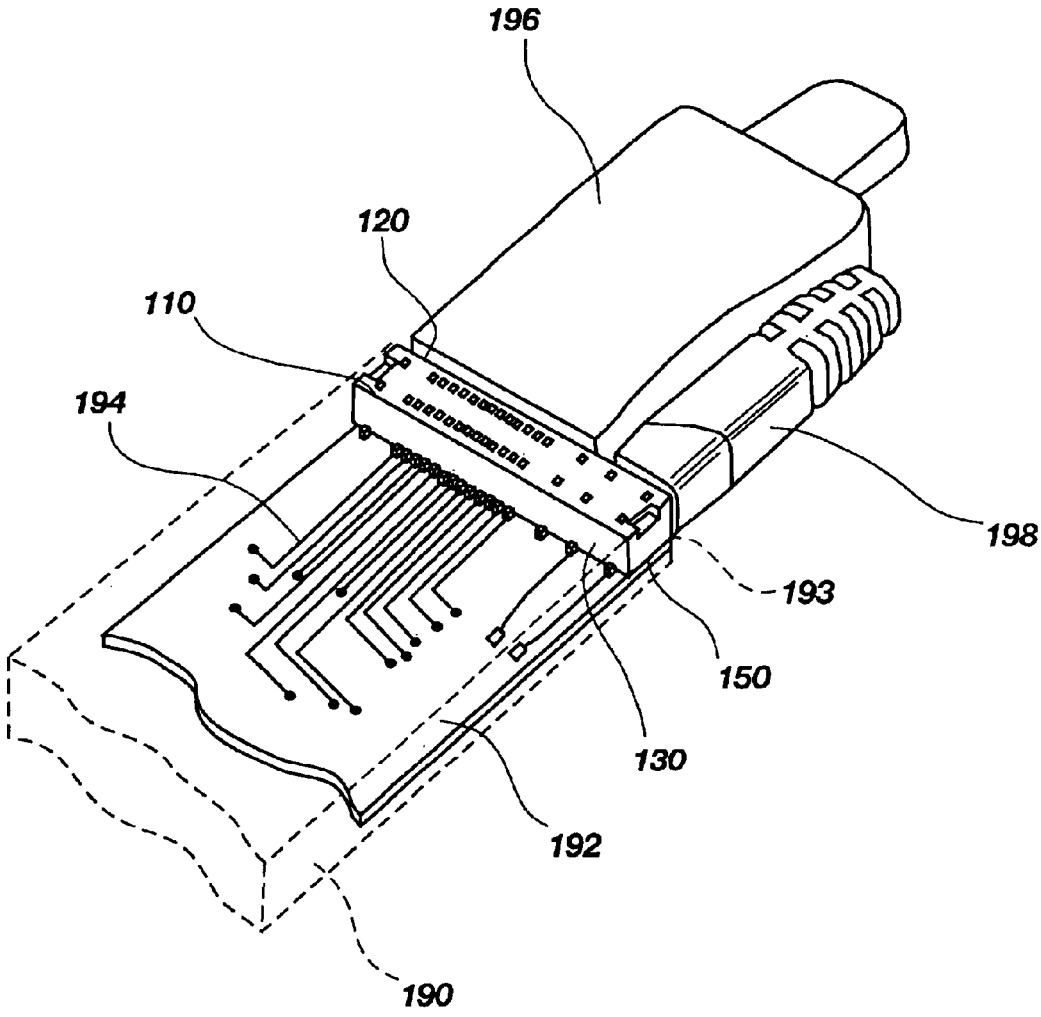
FIG. 6 illustrates a simplified perspective view of a portable electronic system, depicting the interface connector interconnected to the system and the interface connector interfacing with a power cable and data cable.

Turning to FIG. 6, a simplified depiction of a portable electronic device 190 having the interface connector 110 is illustrated. Such a portable electronic device 190 may be, but is not limited to, a portable phone or PDA. The portable electronic device 190 can include a printed circuit board 192 ("PCB") to which the interface connector 110 is electrically interconnected. At least a portion of the front surface 120 of the interface connector is exposed at a portion of a periphery 193 of the portable electronic device 190. The interface connector 110 is attached at an end portion of the PCB 192 so that the shoulder portion 164 of the strike plates 160 exposed at the back and bottom surfaces 130 and 150 of the interface connector 110 can be in electrical communication with electrical interconnections and traces 194 on and/or in the PCB 192. With this arrangement, the improved planarity and pitch of the strike plates 160 in the interface connector 110, as previously set forth, provide improved and more reliable interconnection with the interconnections and traces 194 on the PCB 192. In this manner, the interface connector 110 acts as an interface to both power and transfer data to the portable electronic device 190 via a power cable 198 and a data cable 196, respectively.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth herein.

What is claimed is:

1. An elongate connector housing for a portable electronic device configured to receive conductive plates therein, the elongate connector housing comprising:

a front side configured to be at least partially exposed at a peripheral portion of the portable electronic device, the front side defining port openings therein configured to receive at least one of power and data interconnections to the portable electronic device; and a bottom side adjacent to the front side, the bottom side having plate openings defined therein, the plate openings being configured to receive the conductive plates therein at the bottom side, the bottom side being configured to provide a barrier for substantially consistent insert depth between the conductive plates with respect to the bottom side for electrical interconnection to a printed circuit board disposed in the portable electronic device.

2. The elongate connector housing of claim 1, further comprising a top side, opposite of the bottom side, defining alignment retaining openings therein, the alignment retaining openings being configured to correspond with the plate openings and extending therefrom and configured to receive a portion of the conductive plates.

3. The elongate connector housing of claim 2, wherein the alignment retaining openings comprise at least two openings for each plate opening.

4. The elongate connector housing of claim 1, further comprising a back side, opposite the front side, defining at least one notch therein, the at least one notch configured to receive a portion of the conductive plates.

5. The elongate connector housing of claim 4, wherein the bottom side comprises at least one channel defined therein and extending from each of the plate openings to the at least one notch defined in the back side.

6. The elongate connector housing of claim 1, wherein the bottom side comprises at least one channel defined therein and extending from each of the plate openings, the at least one channel configured to receive a shoulder portion of the conductive plates to facilitate the substantially consistent insert depth between each of the conductive plates.

7. An interface connector configured for a portable electronic device, the interface connector comprising:

conductive plates; and an elongate housing including:

a front side configured to be at least partially exposed at a peripheral portion of the portable electronic device, the front side defining port openings therein configured to receive at least one of a power interconnection and a data interconnection to the portable electronic device; and a bottom side adjacent to the front side, the bottom side having plate openings defined therein, the plate openings being configured to receive the conductive plates therein at the bottom side, the bottom side being configured to provide a barrier for substantially consistent insert depth between the conductive plates with respect to the bottom side for electrical interconnection to a printed circuit board disposed in the portable electronic device.

8. The interface connector of claim 7, further comprising a top side, opposite of the bottom side, defining alignment retaining openings therein, the alignment retaining openings corresponding to each of the plate openings and extending therefrom and configured to receive a portion of the conductive plates.

9. The interface connector of claim 8, wherein the alignment retaining openings comprise at least two openings for each plate opening to receive extension portions of the conductive plates.

10. The interface connector of claim 7, further comprising a back side, opposite the front side, defining at least one notch therein, the at least one notch configured to receive a portion of the conductive plates.

11. The interface connector of claim 10, wherein the bottom side comprises at least one channel defined therein and extending from each of the plate openings to the at least one notch defined in the back side, the at least one channel configured to receive a shoulder portion of the conductive plates.

12. The interface connector of claim 7, wherein the bottom side comprises at least one channel defined therein and extending from each of the plate openings, the at least one channel configured to receive a shoulder portion of the conductive plates to facilitate the substantially consistent insert depth between each of the conductive plates.

13. A method for making an interface connector for a portable electronic device, the method comprising:

providing an elongate housing including a front side and a bottom side, the bottom side adjacent the front side, the front side configured to be at least partially exposed at a peripheral portion of the portable electronic device and the front side defining port openings therein configured to receive at least one of a power interconnection and a data interconnection to the portable electronic device, the bottom side having plate openings defined therein; and inserting conductive plates in each of the plate openings into the bottom side of the elongate housing so that a portion of each of the conductive plates is positioned against the bottom side of the elongate housing, the bottom side being configured to provide a barrier for substantially consistent insert depth between each of the conductive plates with respect to the bottom side for electrical interconnection a printed circuit board disposed in the portable electronic device.

14. The method of claim 13, wherein the inserting comprises inserting the conductive plates into the plate openings so that extension portions of the conductive plates extend into alignment retaining openings defined in the plate openings and extending through a top side of the elongate housing.

15. The method of claim 13, wherein the inserting comprises inserting the conductive plates into the plate openings so that a shoulder portion of the conductive plates is positioned within a channel portion defined in the bottom side of the elongate housing.

* * * * *